US005642596A

United States Patent [19]

Waddington

[11] Patent Number: 5,642,596

[45] Date of Patent: Jul. 1, 1997

[54] SHINGLE ROOFING ASSEMBLY

[76] Inventor: Richard Waddington, 22 Eden Street, Adelaide, South Australia, Australia

[21] Appl. No.: 535,156

[22] PCT Filed: Apr. 19, 1994

[86] PCT No.: PCT/AU94/00203

§ 371 Date: Oct. 20, 1995

§ 102(e) Date: Oct. 20, 1995

[87] PCT Pub. No.: WO94/24384

PCT Pub. Date: Oct. 27, 1994

[30] Foreign Application Priority Data

Apr. 22, 1993 [AU] Australia ..... PL8397

[51] Int. Cl.[6] ..... E04D 1/34

[52] U.S. Cl. ..... 52/546; 52/550; 52/551

[58] Field of Search ..... 52/544–552, 478

[56] References Cited

U.S. PATENT DOCUMENTS

| | | | |
|---|---|---|---|
| 282,439 | 7/1883 | Chambers | 52/547 |
| 2,149,818 | 3/1939 | North | 52/547 X |
| 2,164,712 | 7/1939 | Kirschbraun | 52/547 X |
| 2,511,083 | 6/1950 | Small | 52/547 |
| 3,373,534 | 3/1968 | Berridge | 52/544 X |
| 4,015,391 | 4/1977 | Epstein et al. | 52/547 X |
| 4,426,823 | 1/1984 | Kobe | 52/544 X |
| 4,958,471 | 9/1990 | Waddington | 52/550 X |

FOREIGN PATENT DOCUMENTS

| | | | |
|---|---|---|---|
| 347925 | 5/1931 | United Kingdom | 52/544 |

*Primary Examiner*—Wynn E. Wood
*Assistant Examiner*—Beth Aubrey
*Attorney, Agent, or Firm*—Klauber & Jackson

[57] ABSTRACT

A tile roof fixing system for securing roof tiles/shingles to a roof structure wherein a plurality of rows of tiles/shingles are supported by spaced apart parallel battens, with each tile/shingle having an upper end portion supported by one batten and a lower end portion supported by an adjacent lower batten, the lower end portion of each tile/shingle overlapping the upper end portion of an adjacent lower tile/shingle. Each of the tiles/shingles is supported along its opposite longitudinal margins by a pair of relatively short parallel joining strips which extend between and are supported by a pair of adjacent battens, each strip having a length such that its lower end portion projects beyond the lower one of the pair of adjacent battens. The joining strips are mechanically interlocked with the battens adjacent their lower ends and are each provided with integral locking means for securing the lower end portion of a tile/shingle against upward lift.

14 Claims, 5 Drawing Sheets

SHINGLE ROOFING ASSEMBLY

This invention relates to an improved tile roofing system and in particular to an improved fixing system for securing together flat shingles/tiles which can be glass, ceramic, slate, timber, plastic, cement or terracotta, for constructing a shingled roof.

It is well known that flat shingled roofing and wall tile/slates are expensive due to the need for 60% minimum surface lap over each shingle to offer an effective weather seal where joins occur. Not only does this require an enormous amount of material but is labour intensive. To attach such a roof using the present traditional system requires each shingle to be nailed at the top edge to a wooden batten, overlapped by approximately 50% of its neighbouring shingle on lengthwise joints and by approximately 60% of the shingle in the adjacent upper row on the transverse joints.

An object of this invention is to provide a roof fixing system which will allow the amount of shingles or tiles required to be reduced by up to 50% (in comparison with known art) and thereby significantly reduce both material and labour costs associated with tiled roof constructions.

Another object of the invention is to provide improved roof tile securing means whereby each tile/shingle has its lower end secured against upward lift so as to provide improved resistance to wind and weather. This is particularly desirable in built-up areas which suffer severe storms such as cyclones.

According to this invention therefore, an improved roof tile/shingle fixing system for securing roof tiles/shingles to a roof structure comprises:

a plurality of elongate tile/shingle support battens arranged to be secured to the roof structure in spaced apart parallel relationship for supporting rows of horizontally aligned tiles/shingles transversely of the battens on an inclination, with each said tile/shingle having an upper end portion supported by one support batten and a lower end portion supported by an adjacent lower batten, said lower end portion overlapping the upper end portion of an adjacent lower tile, a plurality of spaced apart parallel elongate joining strips each extending between a pair of adjacent said battens and supported thereby, each said strip having a length such that its lower end portion projects beyond the lower one of said pair of adjacent battens, constructed and arranged so that each said tile/shingle can be supported along its opposite margins by a pair of adjacent said strips with the upper surface of each said strip in contact with and supporting adjacent marginal edge portions of adjacent tiles/shingles of a said row, securing means for securing the strips to the battens, and locking means associated with each said strip for securing the lower end portion of a respective said tile/shingle against upward lift.

In a preferred embodiment of the invention, each of the tile support battens is formed of sheet metal and has an upstanding web, an upper flange extending to one side of said web, and a lower flange extending to the other side of said web, the flanges being approximately parallel, wherein each of the strips has its upper end resting on the upper surface of the lower flange of one batten and a lower end portion thereof supported on the upper surface of the upper flange of an adjacent lower batten.

In another preferred embodiment of the invention, said locking means comprises a pair of spaced bendable upstanding tabs at the lower end of each said strip and integrally formed therewith, said pair of tabs being arranged to be respectively crimped over the lower ends of a pair of adjacent side-by-side tiles/shingles which have their adjacent marginal edge portions supported on said strip.

Preferably each said strip has an upper flange locating slot adjacent its underside surface near to and facing in the direction of its lower end, said upper flange of each said tile support batten being arranged to lockingly engage within a respective said slot, such that with the upper flange so engaged, the lower end portion of each said strip is restrained against upward lifting movement.

Preferably each said joining strip is provided with a pair of downwardly turned marginal flanges extending along opposite sides thereof, said flanges terminating short of the lower end of said strip, each said flange having a slot extending inwardly from its bottom end edge, the slots being transversely aligned.

Preferably each said joining strip has formed in its upper surface grooves which extend along the entire length thereof, said grooves constituting water flow paths for shedding of water from its lower end, and which reduce the likelihood of water leakage into the roof structure.

Preferably each said tile support batten is formed as an integral metal strip of approximately Z cross-sectional shape, with its lower flange having at least one rib formation extending longitudinally along the length thereof. Preferably the lower flange terminates in an upwardly turned lip formation.

Preferably the tiles/shingles are flat and have planar upper and underside surfaces.

According to another aspect of the present invention, a tile roof structure comprises:

a plurality of elongate tile support battens each formed as an integral thin metal strip of approximately Z cross-sectional shape defined by an upstanding web, an upper flange extending to one side of said web, and a lower flange extending to the other side of said web, the flanges being approximately parallel, securing means for securing said tile support battens to the roof structure in mutually spaced apart parallel relationship, a plurality of relatively short elongate joining strips supported in spaced apart parallel relationship on said battens, with each said strip having its upper end resting on the upper surface of the lower flange of one batten and being supported near its lower end on the upper surface of the upper flange of an adjacent lower batten, each said strip having a length such that its lower end projects beyond said adjacent lower batten, securing means for securing said strips to the battens, and a plurality of rows of tiles respectively supported between a pair of adjacent said battens, with adjacent tiles in each said row being arranged in edge-to-edge, non-overlapping relationship, each said tile having a lower end portion overlapping the upper end portion of an adjacent lower tile, and wherein each said tile is supported along its opposite marginal edges by a pair of adjacent said strips, with the upper surface of each said strip being contiguous with and supporting adjacent marginal edge portions of a pair of adjacent tiles of a said row, wherein each said strip has associated therewith locking means for securing the lower end portion of at least one said tile against upward lift.

Preferably, the tiles are flat slate shingles.

Preferably, the joining strips are each formed as an integral metal strip having a length which approximates to the length of said tiles.

Preferably said locking means comprises a pair of upstanding bendable tabs integrally formed with the strip at its lower end and arranged to be crimped over the lower edges of a pair of adjacent said tiles supported on that said strip.

The present invention makes it possible to construct a tile roof with a significantly reduced volume of tiles (in comparison with known shingled roofs), and enables a roof to be easily and rapidly installed with minimum labour and which is neat in appearance. In addition the ability of the support strips to lockingly retain the lower ends of the tiles provides a convenient means of preventing the tiles from being uplifted by high velocity winds. Still further, it is advantageous that the adjacent tiles of each horizontal row do not need to overlap one another due to the support provided by the underlying support strips and the ability of those strips to shed water which may enter into the join between the adjacent lengthwise margins of the tiles.

In order to more fully explain the present invention, several embodiments thereof are described hereunder in some further detail with reference to and as illustrated in the accompanying drawings in which.

Figure 1:
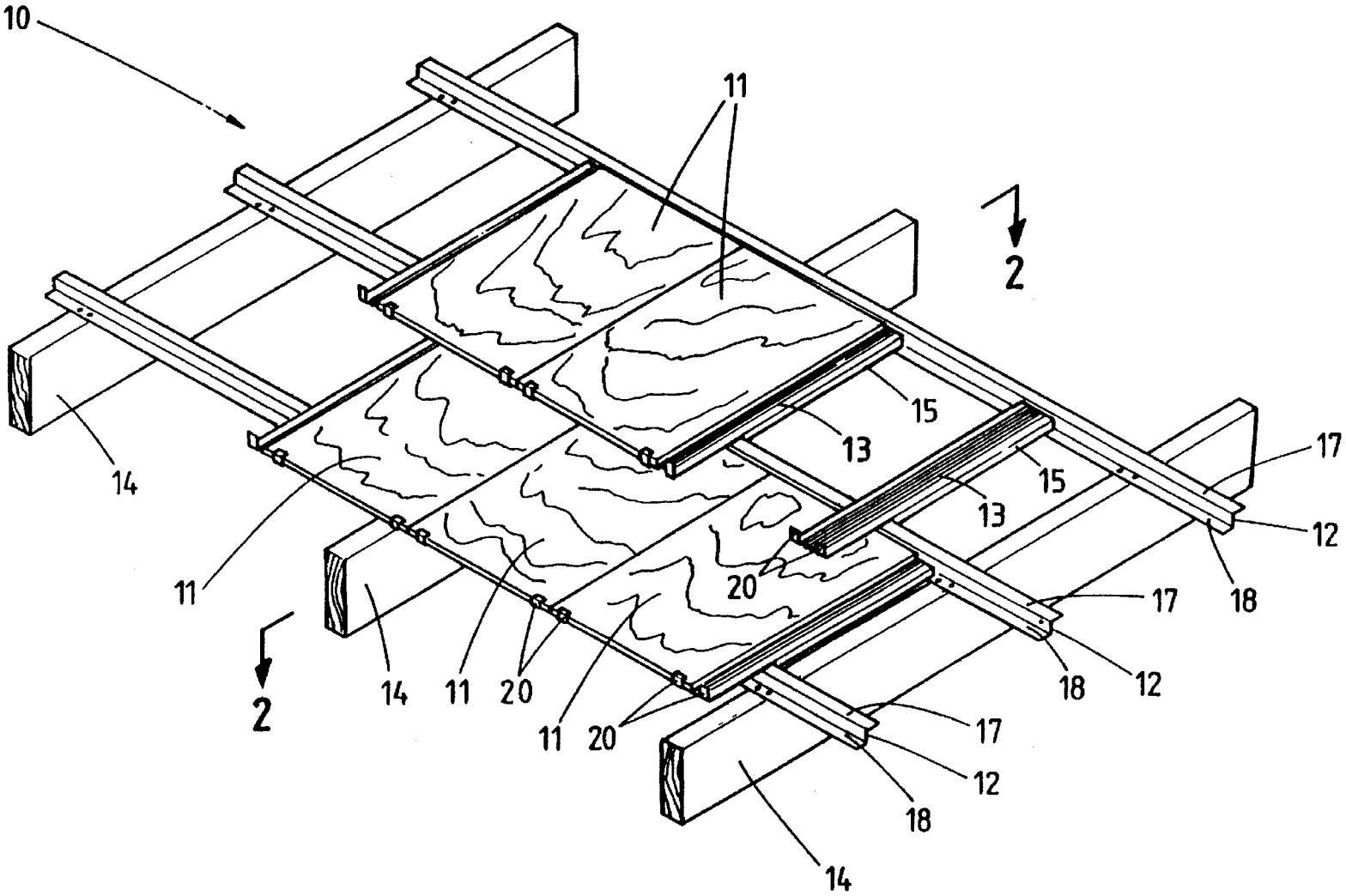
FIG. 1 is a perspective view of part of a roof structure having supported thereon a tiled/shingled roof according to a first embodiment of the invention.
Figure 2:
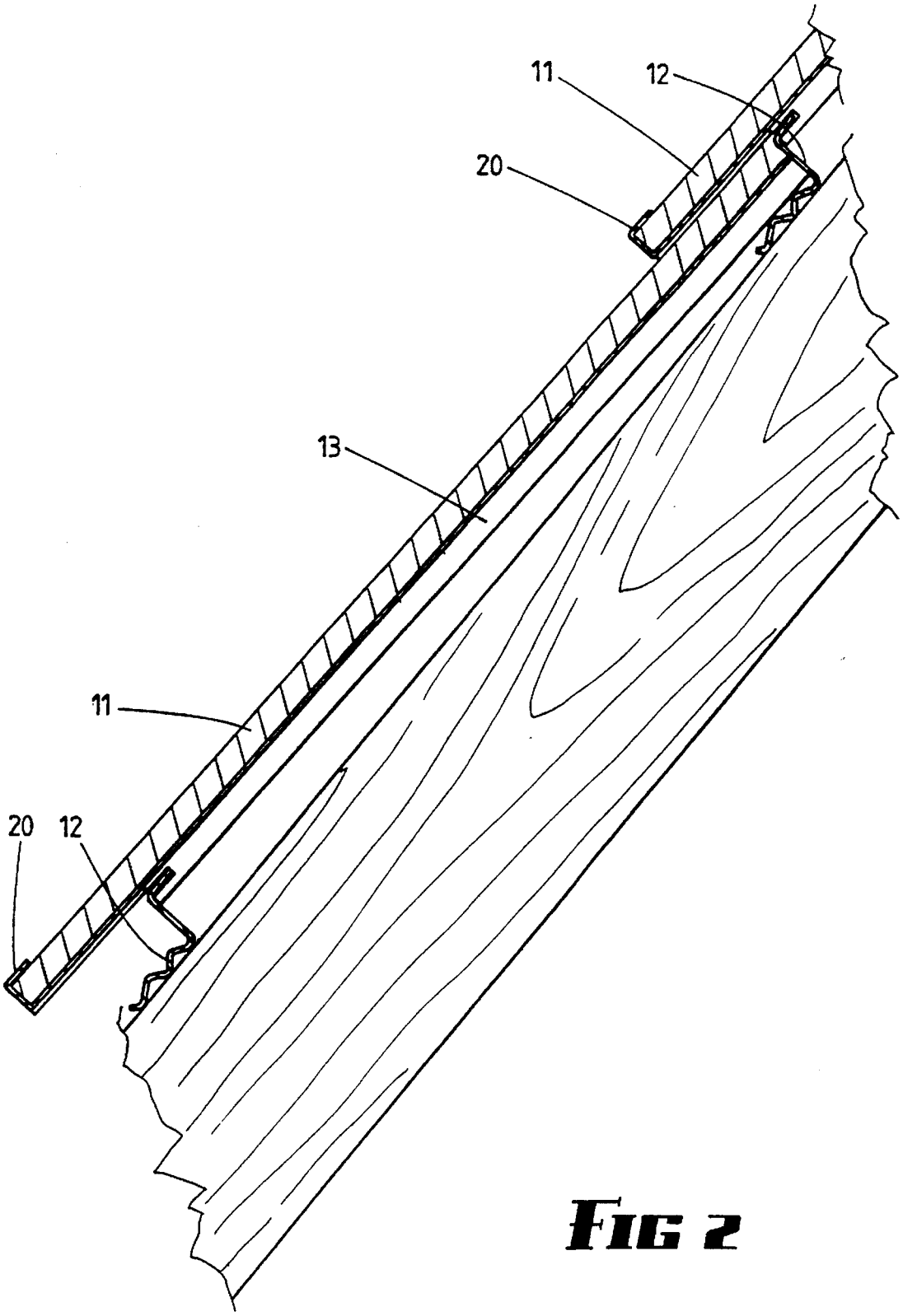
FIG. 2 is a fragmentary sectional view along the line 2—2 in FIG. 1.

With reference to FIGS. 1–4 of the accompanying drawings, there is shown a shingled roof assembly 10 comprising rows of shingles (or tiles) 11 supported by a series of spaced apart parallel support battens 12 and a plurality of relatively short spaced joining strips or rails 13 which extend between pairs of adjacent battens 12 at right angles thereto. The battens 12 are supported by timber rafters 14 in accordance with well known art. In this embodiment each of the shingles 11 is formed of slate whilst the battens 12 and strips 13 are roll formed from sheet metal. The battens 12 have an approximate Z cross-sectional shape.

As shown in FIG. 1, the shingles 11 are laid in rows in abutting edge-to-edge relationship, with each shingle 11 having its lower end portion overlapping the upper end portions of a pair of adjacent shingles 11 in the adjacent lower row. Each joining strip 13 is arranged to support a pair of adjacent shingles 11 in each row along their adjacent longitudinal margins, the spacing between the strips 13 being determined by the width of the slate shingles 11.

Each of the joining strips 13 is provided with depending marginal flanges 15 which extend along part only of the opposite sides of the strip, the flanges 15 having formed therein lengthwise extending, transversely aligned slots 16 which are near to and face in the direction of the lower end of the strip 13. The slots 16 slidably engage with the upper flange 17 of the Z section metal battens 12 so as to interlock the joining strip to the batten, with the upper end of each strip being preferably fastened to the lower flange 18 of an adjacent higher batten 12 by means of a fastener, e.g. a screw or nail.

Each of the strips 13 is also provided with a pair of upstanding bendable tabs 20 at its lower end, the tabs 20 being arranged to be crimped over the lower ends of adjacent shingles 11 to provide hook formations which serve to hold down the lower ends of the shingles 11 and prevent them from lifting up in high winds. The bending operation would normally be performed by a roof contractor after having positioned the shingles 11 in place.

Figure 3:
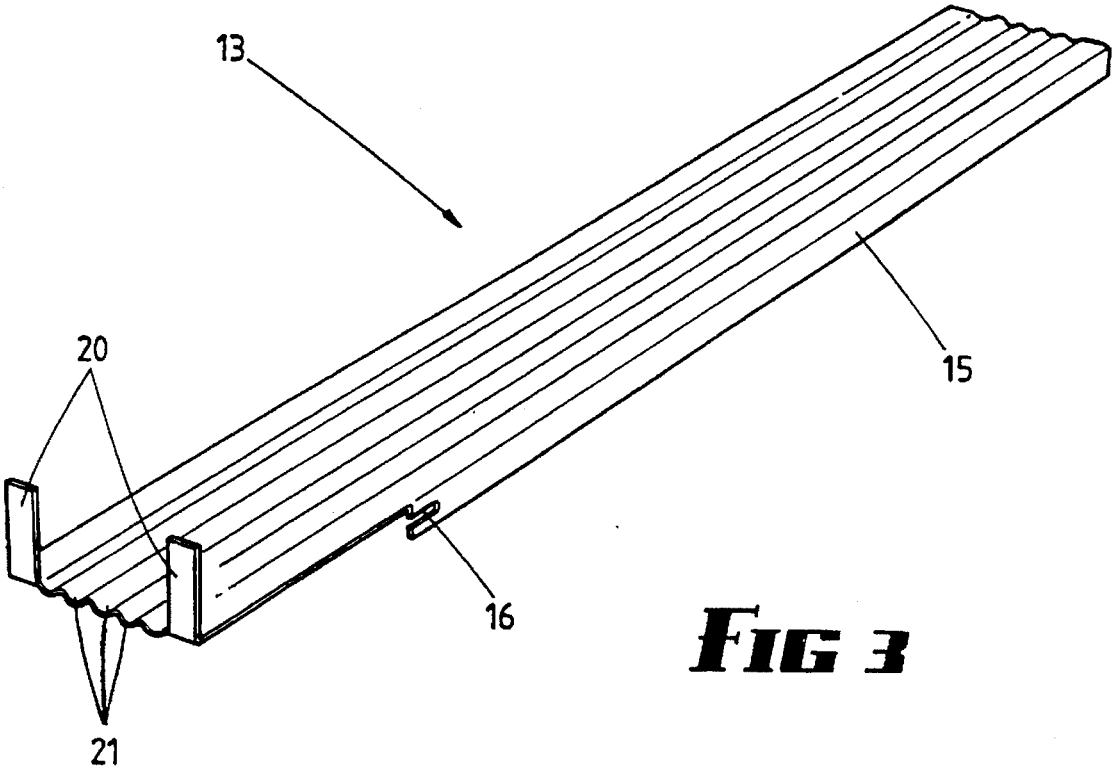
FIG. 3 is an underside perspective view of a tile support joining strip which spans adjacent battens of the roof structure shown in FIG. 1.

As shown in FIG. 3, each of the joining strips 13 is provided with a series of lengthwise corrugations 21 which extend along the whole length of the strip in a central region thereof, the corrugations 21 serving to stiffen the metal strip while at the same time provide a series of water flow channels which assist in the shedding of water which might enter through the joins between adjacent tiles.

It would of course be appreciated that the joining strips 13 can be adjusted to accommodate any size shingle by sliding same horizontally along the battens 12 and can be cut off to any desired length to accommodate batten spacing.

Figure 4:
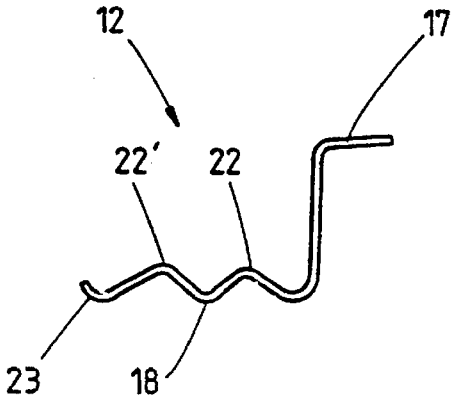
FIG. 4 is a end elevational view of one of the tile support battens shown in FIG. 1.

Referring to FIG. 4 of the drawings, the lower flange of the Z section metal batten 12 is formed with a pair of curved ribs 22, 22' in its upper surface and which extend along the entire length of the batten. The ribs 22, 22' are shaped and dimensioned so that with the batten mounted on an inclination on top of the rafters 14, the upper end portions of the joining strips 13 make bearing contact with the crests of the ribs. Preferably the lower flange 18 of each batten 12 terminates at its free edge in an upturned lip 23.

Figure 5:
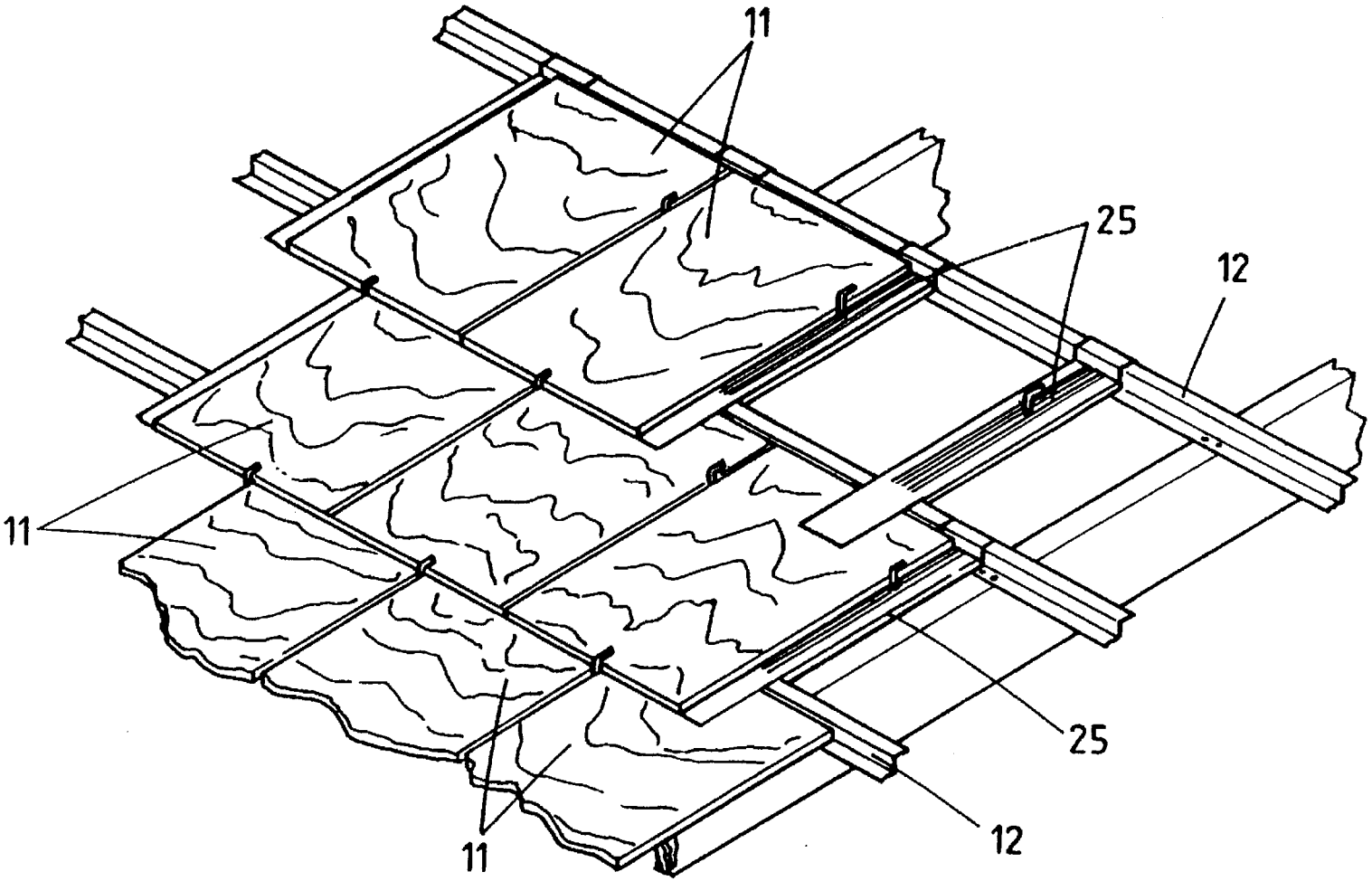
FIG. 5 is a view similar to FIG. 1 showing a tile fixing system according to a second embodiment of the invention.
Figure 6:
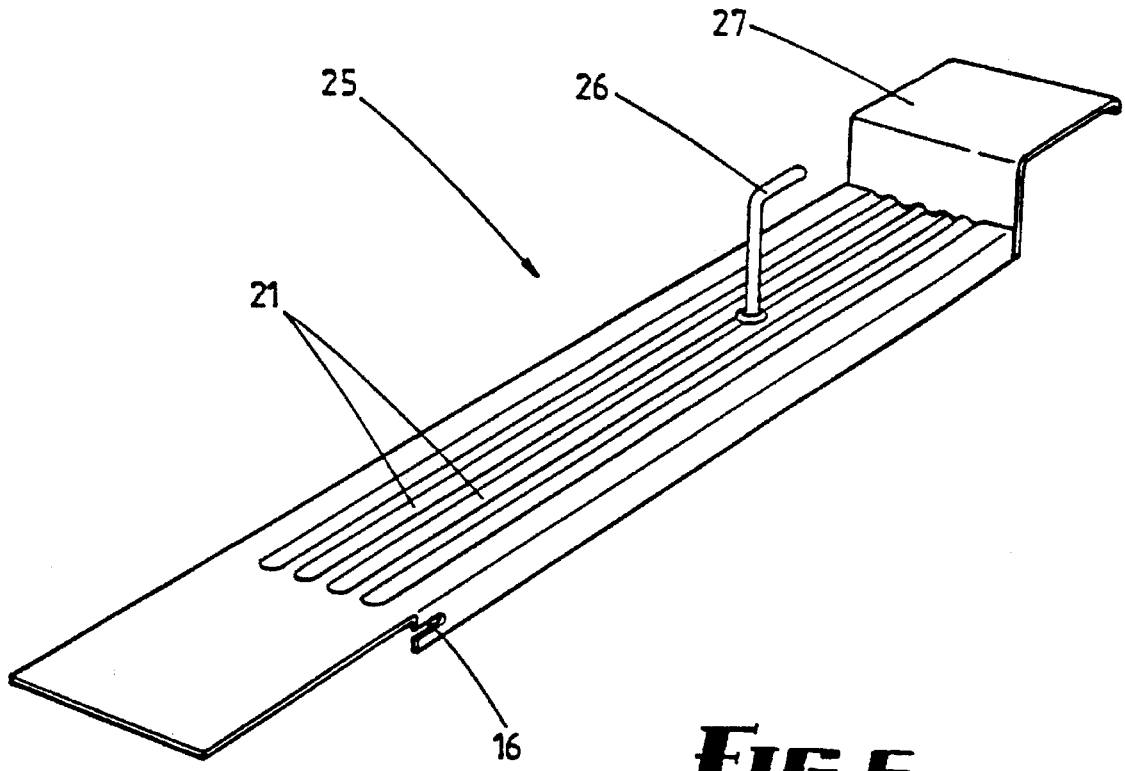
FIG. 6 is a perspective view of one of the joining strips shown in FIG. 5; whilst

With reference to the second embodiment of the invention shown in FIGS. 5 and 6 of the accompanying drawings, the same item numbers are used to denote equivalent parts to those of the first embodiment. The shingles 11 are supported in an almost identical manner to that of the first embodiment, by means of metal battens 12 and joining strips which extend between adjacent battens at right angles thereto, with each joining strip supporting a pair of adjacent shingles 11 along their adjacent longitudinal margins. In this embodiment, however, each of the joining strips 25, rather than having upstanding tabs formed at its bottom end, is provided with a centrally located upstanding locking finger 26 which has its upper end portion bent over in the direction of the upper end of the strip so as to form a hook. As shown in FIG. 5, each of the locking fingers 26 is arranged to locate over the lower end of an adjacent tile in the adjacent upper row in order to hold down its lower end. In this embodiment each of the shingles 11 abuts against the locking fingers 26 of adjacent joining strips 25 between which the shingle spans.

The upper end of each joining strip 25, in this embodiment, is provided with an L-shaped bracket arm 27 which locates over the upper flange of one of the battens 12. By having the upper and lower ends of each joining strip 25 mechanically interlocked with adjacent battens 12, the use of any fasteners such as screws or nails is avoided.

Figure 7:
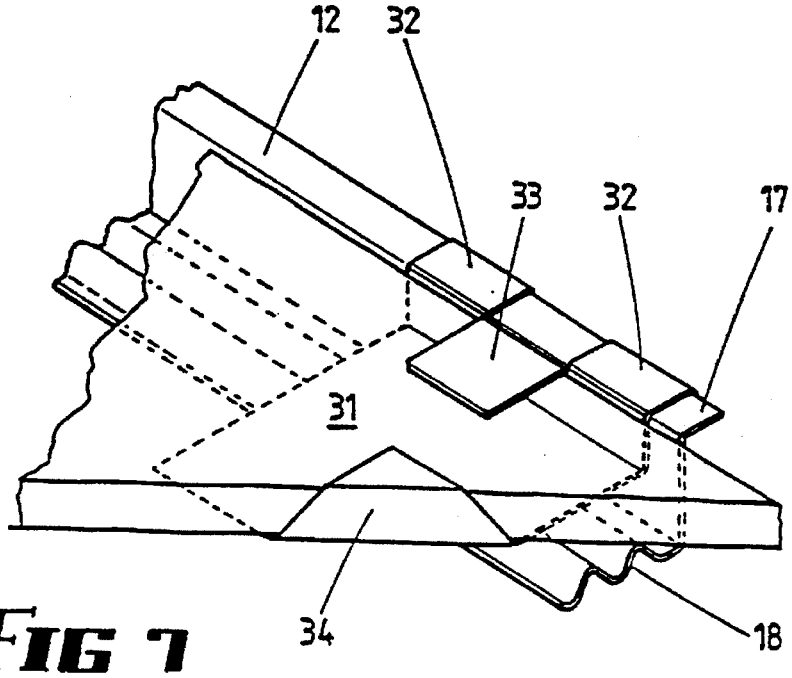
FIG. 7 is a fragmentary perspective view of a tile which borders a roof valley and is supported by a further securing bracket which clips onto a roof batten.

Referring to FIG. 7 of the drawings, there is shown a bracket 31 which supports a portion of a shingle 11 so that its undersurface is held clear of the bottom flange 18 of the batten 12. This is particularly desirable for tiles which border a valley in the roof. The bracket 31 is formed with bendable fastening tabs 32 which are crimped over the upper flange 17 of the batten 12, separated by a central tongue 33 which is crimped in the opposite direction to the tabs 32 so as to locate over the upper surface of the shingle 11 and securely hold it in place. The bracket 31 is also provided at one of its corners with a foldable diagonal tab 34 which is arranged to crimp over a cut diagonal edge of the shingle 11 so as to ensure that the shingle 11 is held firmly in position.

In the case of low pitched roofs, a sealing mastic or elongate sealing strips can be attached adjacent opposite sides of the joining strips 13 so as to create a watertight seal on the underside of the shingles 11.

The joining strips 13 provide firm support for the shingles 11 along their longitudinal margins while saving a complete layer of shingles and reduces the lap over in the lengthwise direction of the shingles to approximately 10% of the shingle surface area.

The actual laying method for the roof shingles of this invention will of course be self evident as will the simplicity and quickness of such method.

It should be realised that the present invention can also be used in conjunction with conventional timber battens by nailing each joining strip through the top of an associated shingle into the batten below.

A brief consideration of the abovedescribed embodiments will indicate that the invention provides for an extremely simple and effective flat shingle/tile cladding means for roofs wherein the likelihood of the shingles being uplifted by high velocity winds is minimal.

The claims defining the invention are as follows:

1. An improved fixing system for securing roof tiles/shingles to a roof structure comprising:

a plurality of elongate tile/shingle support battens arranged to be secured to the roof structure positioned on an incline in spaced apart parallel relationship for supporting rows of tiles/shingles transversely of the battens, with each said tile/shingle having an upper end portion supported by one support batten and a lower end portion supported by an adjacent lower batten, said lower end portion overlapping the upper end portion of an adjacent lower tile;

a plurality of spaced apart parallel joining strips each extending between a pair of adjacent said battens and supported thereby, each said strip having a length such that a lower end portion projects beyond the lower one of said pair of adjacent battens, wherein opposite edge portions of each said tile/shingle are supported by a pair of adjacent said strips with an upper surface of each said strip being in contact with and supporting adjacent edge portions of adjacent tiles/shingles positioned in edge-to-edge relationship; and locking means associated with each said strip for securing the lower end portion of a respective said tile/shingle against upward lift; and securing means for securing the strips to the battens;

wherein said locking means comprises a pair of transversely spaced apart upstanding tabs or tongues at the bottom end of the strip integrally formed therewith, said tabs or tongues being arranged to be crimped over the lower edge portions of adjacent side-by-side shingles so as to restrain same against upward lifting movement.

2. An improved fixing system according to claim 1 wherein each of said tile support battens has an upstanding web, an upper flange extending to one side of said web, and a lower flange extending to the other side of said web, the flanges being approximately parallel, wherein each of the strips has an upper end resting on the upper surface of the lower flange of one batten and a lower end thereof supported on the upper surface of the upper flange of an adjacent lower batten.

3. An improved fixing system according to claim 2 wherein each said joining strip is provided with an upper flange locating slot adjacent an underside surface of said joining strip near to and facing in the direction of the lower end portion of the strip, said upper flange of each said batten being snugly engaged within a respective said slot, to thereby mechanically interlock the strip to a respective one of the tile support battens.

4. An improved fixing system according to claim 1 wherein each said joining strip comprises longitudinally extending grooves formed in the upper surface to assist the shedding of water therefrom.

5. An improved fixing system according to claim 2 wherein the upper end portion of each said joining strip is secured to the lower flange of a respective said batten by one or more fasteners such as screws, rivets or the like.

6. An improved fixing system according to claim 2 wherein the lower flange of each said tile support batten is formed with at least one upstanding rib in the upper surface thereof and extending along the entire length of the batten.

7. An improved fixing system according to claim 6 wherein said lower flange further comprises an upturned lip disposed at a free longitudinal margin of said lower flange.

8. An improved fixing system according to claim 1 wherein said tile support battens and said joining strips are roll formed from sheet metal.

9. An improved fixing system according to claim 1 wherein said tiles or shingles are formed of slate and have planar upper and lower major surfaces.

10. A tile roof structure for attachment to a roof substructure comprising:

a plurality of elongate tile support battens each formed as an integral thin metal strip of approximately Z cross-sectional shape defined by an upstanding web, an upper flange extending to one side of said web, and a lower flange extending to the other side of said web, the flanges being approximately parallel;

securing means for securing said tile support battens to the roof substructure in mutually spaced apart parallel relationship;

a plurality of relatively short joining strips supported in spaced apart parallel relationship on said battens, with each said strip having an upper end resting on the upper surface of the lower flange of one batten and having a lower end supported on the upper surface of the upper flange of an adjacent lower batten, each said strip having a length such that the lower end projects beyond said adjacent lower batten;

securing means for securing said strips to the battens; and a plurality of rows of tiles respectively supported between a pair of adjacent said battens, with adjacent tiles in each said row being arranged in edge-to-edge, non-overlapping relationship, each said tile having a lower end portion overlapping an upper end portion of an adjacent lower tile, and wherein opposite edge portions of each said tile are supported by a pair of adjacent said strips, with an upper surface of each said strip being contiguous with and supporting adjacent edge portions of a pair of adjacent tiles of a said row;

wherein each said strip has associated therewith locking means for securing the lower end portion of a said tile against upward lift; and wherein said locking means comprises a pair of transversely spaced apart upstanding tabs at the lower end of the strip integrally formed therewith, said tabs being crimped over lower edge portions of adjacent side-by-side tiles in order to restrain said tiles against upward lifting movement.

11. A tile roof structure according to claim 10 wherein each said joining strip is provided with a slot adjacent an underside surface near to and facing in the direction of the lower end, said upper flange of each said batten being snugly engaged within a respective said slot, to thereby mechanically interlock the strip to a respective one of the tile support battens.

12. An improved fixing system according to claim 10 wherein each said joining strip comprises a series of longitudinally extending grooves formed in the upper surface of said strip which serve as water flow channels for assisting the shedding of water which may enter through the longitudinal join between adjacent tiles of a said row.

13. An improved fixing system according to claim 10 wherein said securing means for securing said strips to the battens further comprises screws, nails or rivets, said screws, nails or rivets fastening the upper ends of the joining strips to the lower flanges of the battens.

14. An improved fixing system for securing roof tiles/shingles to a roof structure comprising:

a plurality of elongate tile/shingle support battens arranged to be secured to the roof structure positioned on an incline in spaced apart parallel relationship for supporting rows of tiles/shingles transversely of the battens, with each said tile/shingle having an upper end portion supported by one support batten and a lower end portion supported by an adjacent lower batten, said lower end portion overlapping the upper end portion of an adjacent lower tile;

a plurality of spaced apart parallel joining strips each extending between a pair of adjacent said battens and supported thereby, each said strip having a length such that a lower end portion projects beyond the lower one of said pair of adjacent battens, wherein opposite edge portions of each said tile/shingle are supported by a pair of adjacent said strips with an upper surface of each said strip being in contact with and supporting adjacent edge portions of adjacent tiles/shingles positioned in edge-to-edge relationship;

locking means associated with each said strip for securing the lower end portion of a respective said tile/shingle against upward lift; and securing means for securing the strips to the battens;

wherein each of said tile support battens has an upstanding web, an upper flange extending to one side of said web, and a lower flange extending to the other side of said web, the flanges being approximately parallel, wherein each of the strips has an upper end resting on the upper surface of the lower flange of one batten and a lower end thereof supported on the upper surface of the upper flange of an adjacent lower batten; and wherein each said joining strip is provided with an upper flange locating slot adjacent an underside surface of said joining strip near to and facing in the direction of the lower end portion of the strip, said upper flange of each said batten being snugly engaged within a respective said slot, to thereby mechanically interlock the strip to a respective one of the tile support battens.

* * * * *